US011554326B2

(12) United States Patent
Zamperla

(10) Patent No.: US 11,554,326 B2
(45) Date of Patent: Jan. 17, 2023

(54) AMUSEMENT DEVICE

(71) Applicant: ANTONIO ZAMPERLA S.p.A., Altavilla Vicentina VI (IT)

(72) Inventor: Alberto Zamperla, Altavilla Vicentina VI (IT)

(73) Assignee: ANTONIO ZAMPERLA S.p.A., Altavilla Vicentina VI (IT)

( * ) Notice: Subject to any disclaimer, the term of this patent is extended or adjusted under 35 U.S.C. 154(b) by 246 days.

(21) Appl. No.: 16/763,027

(22) PCT Filed: Nov. 13, 2017

(86) PCT No.: PCT/EP2017/079082
§ 371 (c)(1),
(2) Date: May 11, 2020

(87) PCT Pub. No.: WO2019/091589
PCT Pub. Date: May 16, 2019

(65) Prior Publication Data

US 2020/0391124 A1 Dec. 17, 2020

(51) Int. Cl.
*A63G 1/24* (2006.01)
*A63G 7/00* (2006.01)

(52) U.S. Cl.
CPC *A63G 1/24* (2013.01); *A63G 7/00* (2013.01)

(58) Field of Classification Search
CPC ..... A63G 7/00; A63G 21/20; A63G 1/24
(Continued)

(56) References Cited

U.S. PATENT DOCUMENTS 1,745,719 A 2/1930 Sellner
3,554,130 A * 1/1971 Broggie ..... A63G 7/00 104/75
(Continued)

FOREIGN PATENT DOCUMENTS

BE 370 485 6/1930
CN 102343958 2/2012
(Continued)

OTHER PUBLICATIONS

International search report and written opinion dated Oct. 15, 2018 by the EPO for PCT/EP2017/079082.
(Continued)

*Primary Examiner* — Kien T Nguyen
(74) *Attorney, Agent, or Firm* — Silvia Salvadori

(57) ABSTRACT

It is disclosed an amusement device (1) comprising a vehicle (2) riding on a track (3), said vehicle comprising a support frame (4) and a compartment (5) having one or more seats (52) for housing one or more passengers, the compartment being moveably connected to said support frame by a shaft (7), to rotate about an axis (Y) with respect to said support frame, from a first position (P1) to at least one second position (P2) in a rotation angular interval, at least when a centrifugal force acts on the passenger compartment (5). The vehicle comprises at least one restoring element (6) configured to rotate back said compartment (5) towards said first position (P1) for at least part of the angular interval between said at least one second position (P2) and said at least one first position (P1). The restoring element (6) is directly or indirectly constrained to said shaft (7).

34 Claims, 7 Drawing Sheets

(58) Field of Classification Search
USPC ..... 472/36–38, 43
See application file for complete search history.

(56) References Cited

U.S. PATENT DOCUMENTS

| | | | | |
|---|---|---|---|---|
| 7,921,781 | B2 * | 4/2011 | Baker | A63G 27/02 104/60 |
| 9,162,150 | B2 * | 10/2015 | Roodenburg | A63G 7/00 |
| 2003/0172834 | A1 | 9/2003 | De-Gol et al. | |
| 2013/0025491 | A1 | 1/2013 | Crawford | |
| 2016/0220910 | A1 * | 8/2016 | Zamperla | A63G 7/00 |

FOREIGN PATENT DOCUMENTS

| | | |
|---|---|---|
| CN | 105722565 | 6/2016 |
| EP | 0115355 | 8/1984 |
| EP | 1 944 069 | 7/2008 |
| EP | 2175951 | 11/2012 |
| WO | 03082421 | 10/2003 |
| WO | 2015040195 | 3/2015 |
| WO | 2016151113 | 9/2016 |

OTHER PUBLICATIONS

Office Action issued by the CN patent office for corresponding patent application CN No. 201780096812.2 dated Mar. 25, 2021.

* cited by examiner

AMUSEMENT DEVICE

This application is a U.S. national stage of PCT/EP2017/079082 filed on 13 Nov. 2017, the contents of which is incorporated herein by reference in its entirety.

FIELD OF THE INVENTION

The present invention relates to an amusement device. In particular, the amusement device according to the invention is used, for example, in funfairs and theme parks and comprises a vehicle which moves along a track and which is also provided with a compartment for housing one or more passengers, which is rotatably constrained to the vehicle. Such amusement devices are able to create an open experience for the passengers since the compartment for passengers may rotate and extend at least partially out over the track.

BACKGROUND OF THE INVENTION

For example, US2003172834 by the applicant DE-GOLGINO et alii, describes a moving apparatus having a platform provided with a conventional industrial robot, particularly a robot with six inherent moving axes, with base, rocker, robot arm and robot hand carrying a passenger carrier provided with a frame and two seats. The robot is able to move in a controlled way the base, the rocker, the robot arm and the robot hand in order to move the passenger carrier in any direction of the space during the riding of the platform on the track.

This type of moving apparatus is extremely complex from a constructional point of view because of the presence of the robot and the fact that a personal computer has to be mounted onboard the platform to control the movements of the robot's components. Alternatively, an antenna has to be mounted on the platform to receive an external signal that controls the movements of the robot's components. Furthermore, the robot controls any movement of the passenger carrier, in particular during the turns along the track, thus making the experience for the passengers in some ways "piloted".

WO03/082421, discloses a similar amusement ride wherein a vehicle is movable along a track. The vehicle can be rotated about different rotation axes. The rotation is controlled by actuators such as electric motors, or pneumatic systems, thus limiting the experience for the passengers that is also in this case "piloted".

The European patent EP2175951B1, in the name of Vekoma Rides, discloses a roller coaster for simulating a racing position on a motorbike. The passenger assembly includes a frame that is connected to a carriage and that is provided with a chest support, a back restraining member, and a leg restraining device for each leg. Additionally, the frame of the passenger assembly, and in particular the suspension arm, is suspended from the carriage by means of a pivot. The pivot axis is substantially directed longitudinally, i.e. substantially parallel with respect to the advance direction of passenger assembly along the roller coaster track. The passenger assembly will swing in pendulum fashion on a vertical plane as the carriage passes through a turn, that is to say when the frame is subjected to a centrifugal force. The above mentioned pendulum swing is damped by means of two dampers arranged laterally to the suspension arm. When the centrifugal force no longer acts on the frame, that is to say when the carriage passes through a straight path, the frame returns to its initial vertical position being subjected to the gravitational force.

EP0115355 discloses a similar ride provided with a suspended carriage. The suspension is achieved by two support rods connected to each other by means of a shaft, extending along the movement direction of the ride. The suspended carriage can be rotated about the axis defined by the carriage movement direction.

Also in this case, the oscillating movement of the suspended carriage is damped by pneumatic or hydraulic damping cylinders, However, this last type of amusement rides are not without drawbacks. In fact, suspension arm could remain blocked in a tilted position in case the centrifugal force to which the suspension arm is subjected is excessively high, with consequent hazards for the passengers. Additionally, because the vehicles are suspended from the track, the track with the rail is thus necessarily located above the vehicles, this being a disadvantage in that the view of the passengers is obstructed by the rail. Another problem is that the vehicle is hanging in a plane substantially perpendicular to the plane of the rails.

Therefore, there is the need to increase the safety of this kind of amusement devices, while at the same time giving to the passengers an open free experience, not piloted by direct or active control.

It is also known from document WO2015/040195, in the name of the present Applicant, an amusement device wherein a passenger compartment is constrained to an arm that is rotatable about a pivot when the centrifugal force acts on the compartment. The compartment rotates in a plane that is substantially parallel to the plane of the rails. Restoring means are arranged to restore the arm in a first position when the centrifugal force no longer acts on the arm.

In the amusement device disclosed in WO2015/040195 the arm, and the compartment for the passenger, can be restored to the initial position by restoring means, preferably of the passive type. The movement of the arm is not caused by an actuator, or similar actuation means, and is therefore not piloted by any direct, or active, control; the restoring means need thus to cooperate with the arm. More in detail, the restoring means comprise a ramp and at least one variable-length leg sliding along said at least one ramp when a centrifugal force acts on the arm.

An object of the present invention is also to provide an amusement device wherein the experience of the passengers can be increased by giving them an open free experience, not piloted by any direct or active control on the moving arm and the passenger carrier, while providing an effective way of restoring the passengers' compartment in the first, i.e. initial, position.

An object of the present invention is to provide a way to restore the passenger compartment in the first position that is simple to realize and quick and effective in use. The compartment should rotate in a plane that is substantially parallel to the plane of the rails.

Another object of the present invention is to provide an amusement device wherein the restoring means are simple and effective and can provide an effective restoring force in both directions of rotation (clockwise and counterclockwise).

SUMMARY OF THE INVENTION

These and other objects are achieved by the present amusement device according to claim 1 and by the method according to claim 26. Additional features/aspects are presented in the dependent claims.

The amusement device according to the present invention comprises a vehicle riding on a track, preferably on the upper side of the track, the vehicle comprises a support frame and a compartment having one or more seats for housing one or more passengers. The compartment is configured to rotate in a plane that is substantially parallel to the plane of the track (e.g. plane of the rails), preferably above the track, under a centrifugal force during the ride of the vehicle along said rails.

The compartment is moveably connected to the support frame by a shaft, or similar connecting element, to rotate about an axis (also called pivot axis) with respect to the support frame, from a first position to at least one second position in a rotation angular interval, at least when a centrifugal force acts on the passenger compartment. With the wording "shaft" it is identified any element connecting the compartment to the supporting frame and suitable to support the compartment.

The amusement device further comprises at least one restoring element configured to rotate back the passenger compartment towards the first position for at least part of the rotation angular interval between the at least one second position and the at least one first position. The restoring element is directly or indirectly constrained to the shaft. Advantageously, the restoring element is able to rotate back the compartment towards the first position. The direct or indirect constraining of the restoring element with the shaft, allows providing an effective and simple restoring force exerted to rotate back the compartment towards the first position. The restoring element may be attached to an element that is rotated together with the compartment. Restoring means comprising a ramp and at least one variable-length leg sliding along said at least one ramp when a centrifugal force acts on the arm, are excluded from the scope of the present invention. According to different possible embodiments the restoring element exerts a restoring force for a limited part of the rotation angular interval between the first and second positions, or for the complete rotation angular interval between the first and second positions.

In the case the restoring force is exerted for the complete rotation angular interval the restoring element allows to rotate back completely the compartment to the first position, when the lateral (centrifugal) forces no longer act, and the restoring element is also able to retain the compartment in said first position.

If the restoring element is configured to exert the restoring force only for a part of the rotation angular interval, the restoring element rotates back the compartment towards the first position but without reaching the first position. For example, according to an embodiment, the compartment is rotated back to a position, also called intermediate position, that is between the first position and the second position. This aspect allows to increase the experience provided to the passenger, by rotating back the compartment to a different ("intermediate") position with respect to the first position.

According to an aspect, the restoring element is radially arranged with respect to the pivot axis in at least one of said first position and at least one second position, preferably in said first position. According to an aspect, in the first position a longitudinal axis of the restoring element lies in a radial plane that is passing through the pivot axis.

Advantageously, having a radial arrangement of the restoring element with respect to the pivot axis effectively provides the restoring force to the shaft and thus to the passenger compartment in both rotation directions (clockwise and counterclockwise). According to an aspect, in said first position a longitudinal axis of the restoring element is coincident, or parallel, to a longitudinal axis of the vehicle, and/or is coincident or parallel to the advance direction of the vehicle along the track. An advantage of this aspect is that the restoring element is aligned (in-line) with the longitudinal axis and/or with respect the direction of movement of the vehicle.

According to an aspect, the at least one restoring element comprises at least one spring, preferably an extension spring.

According to an aspect, the restoring element comprises a first portion directly or indirectly constrained to the shaft, a second portion directly or indirectly constrained to the vehicle (and in particular to the support frame) and a spring, the first portion and second portion are movable one with respect to another and are configured so that a restoring force is exerted for at least part of movement of the first portion with respect to the second portion. An advantage of this aspect is that a simple and effective restoring element can be provided.

According to an aspect of the invention said first position is a centered (neutral) position with respect to the rails and the track and the at least one second position is an offset position. The centered position may be substantially at half of the distance between the rails of the track (and/or substantially at half of the distance between the ends of an axle of the vehicle). Specifically, the first position is substantially a central (neutral) position, while said at least one second position is when the compartment, or part of them, rotate and extends at least partially out over the track.

According to an aspect of the invention, the vehicle is further provided with at least one damping element configured to damp said passenger compartment for at least part of the rotation angular interval between the at least one second position and the at least one first position.

According to possible embodiments, the at least one damping element can be configured to damp the rotation of the compartment for the complete rotation angular interval between the first position and the at least one second position, or for only a part of the of the rotation angular interval between the first position and the second position. Advantageously, the at least one damping element is arranged and constrained to the shaft in a similar way as disclosed herein with reference to the restoring element; for example in said first position a longitudinal axis of the damping element or elements is preferably coincident or parallel to a longitudinal axis of the vehicle, and/or is coincident or parallel to the advance direction of the vehicle along the track.

The damping elements may be located above the restoring element and may be aligned in a same plane with it. This also allows an effective and simple damping of the rotation movement in both rotation directions (clockwise and counterclockwise).

According to a possible aspect of the present invention, the compartment for the passengers is arranged in front of the pivot axis about which the compartment and the shaft rotates. It has to be understood that the expression "in front of" is used herein to indicate that the passengers compartment, and thus one or more seats, are arranged in front of the pivot axis, with respect to the advance direction of the vehicle on the track. By doing so, when the arm rotates the compartment for housing at least one passenger overhangs the track, thus improving the ride experience and increasing the passenger's fun.

According to an aspect, the one or more seats of the compartment for the passenger is at a distance equal to or less than 2 meters from the pivot axis, preferably equal to or less than 1.5 meters, more preferably equal to or less than 1 meter. The seats may be in front, behind and/or radially located with respect to the pivot axis.

Advantageously, the compartment and in particular the one or more seat is arranged at a reduced distance from the pivot axis thus providing a vehicle having a reduced lateral dimension when the compartment is rotated. This arrangement may also provide a better control of the returning movement of the compartment by means of the position restoring element.

Furthermore, said restoring element is of the passive type. This means that said restoring element is not electrically fed or controlled by a personal computer (or a control unit), thus there is no active or dynamic control contrary to what is disclosed, for example, in US2003172834. This solution allows simplifying the manufacturing, assembly and maintenance of the amusement device according to the invention.

The present invention also relates to a method of operating an amusement device according to invention. It has to be noted that what is herein disclosed and/or claimed with reference to the amusement device can be applied to the method, and viceversa. The method comprises the step of moving said vehicle along a track. At least when a centrifugal force acts on the passenger compartment of the vehicle having one or more seats for housing one or more passengers during the movement along the track, the compartment is rotated about an axis (pivot axis) with respect to said support frame, from a first position to at least one second position in a rotation angular interval. The method further comprises the step of rotating back said compartment towards said first position for at least part of the angular interval between said at least one second position and said at least one first position by at least one restoring element. As mentioned above, the restoring element is directly or indirectly constrained to shaft, i.e. any element connecting the compartment to the supporting frame and suitable to support the compartment.

The present invention also relates to a station for an amusement device, and in particular to a station for the embarkation/disembarkation of passengers into/from a passenger compartment of a vehicle of an amusement device. According to an aspect the positioning element is contacting directly or indirectly the passenger compartment. The station comprises at least on positioning element configured to move said passenger compartment in at least one first position. It has to be noted that the station and in general the positioning element can be used together or independently with the amusement device, and in particular with the vehicle according to the present invention. In other words, the station provided with the positioning element can be used in other amusement device and vehicle with respect to those disclosed/claimed herein.

Advantageously, the positioning element allows to move the compartment in a first position so that the embarkation/disembarkation of the passengers can be carried out with the compartment arranged in a predetermined position, e.g. in the first position. According to an aspect, the positioning element is arranged outside the vehicle so that the positioning element is contacting directly or indirectly the compartment while the vehicle is advancing along the track.

According to an aspect the positioning element is arranged in correspondence of, or at the entrance of, a station for the embarkation/disembarkation of the passenger into/from the passenger compartment. According to an embodiment, the at least one positioning element is arranged at the entrance, or in correspondence of, a platform arranged above a portion of a track in correspondence of the station.

According to an embodiment, the station can be of the type disclosed in document WO2016/151113 in the name of the same applicant. More in detail, according to an aspect, a platform of the station is provided with an opening for the transit of the at least one vehicle in said station, at least one floor element arranged in at least one first position in which said floor element closes said opening and movable from said at least one first position to at least one second position to allow the transit of said vehicle in said station, further comprising returning means configured to move said at least one floor element from said at least one second position back to said at least one first position in which said floor element closes said opening.

DESCRIPTION OF THE FIGURES

One or more embodiments of the present invention are now described in greater detail with reference to the accompanying drawings provided by way of non-limiting example, wherein.

With reference to these figures, the generic amusement device according to the invention is indicated with 1.

DETAILED DESCRIPTION OF THE INVENTION

Figure 1:
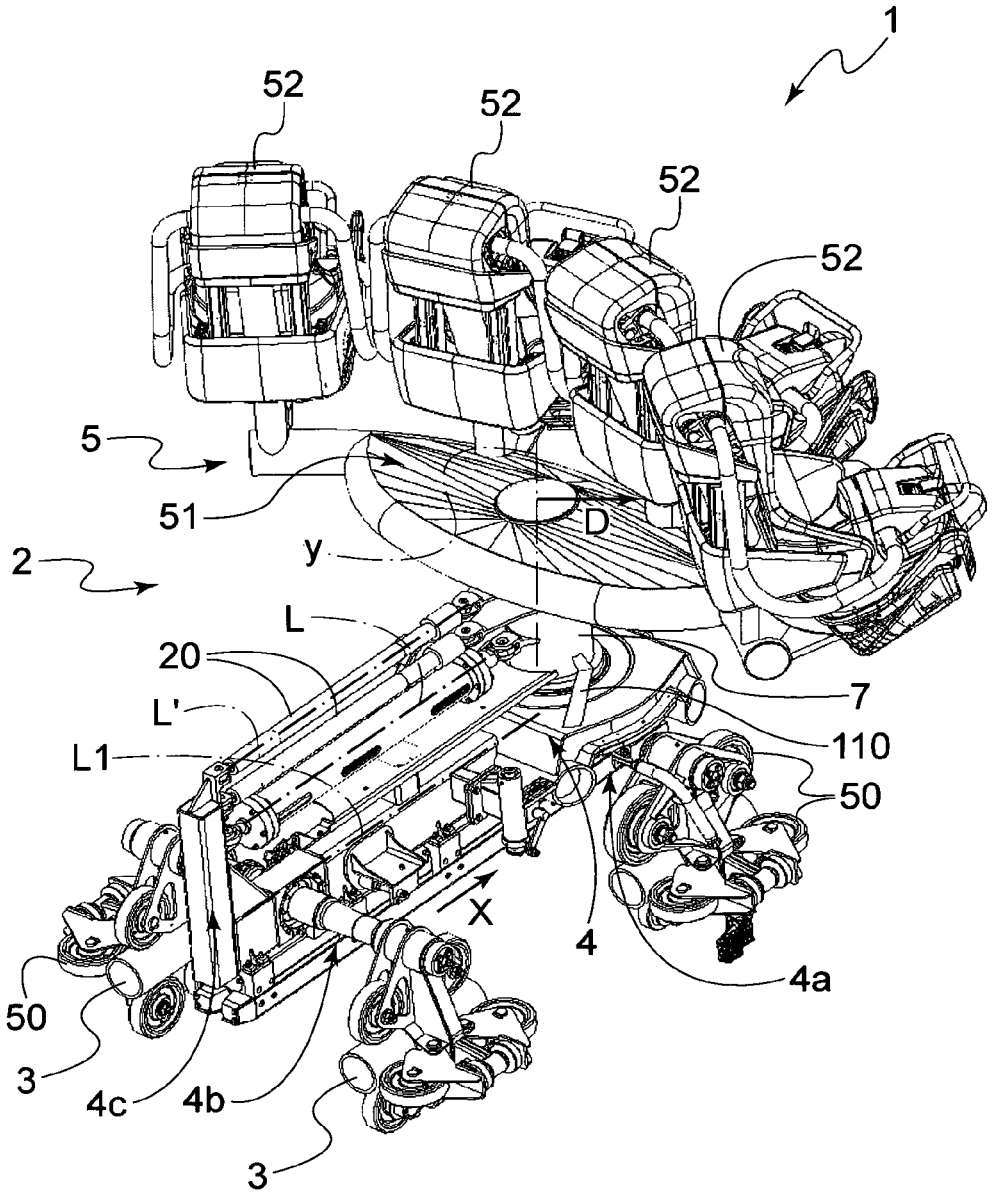
FIG. 1 is a perspective view of the amusement device according to the invention when the compartment for housing one or more passenger is in its first position.
Figure 2:
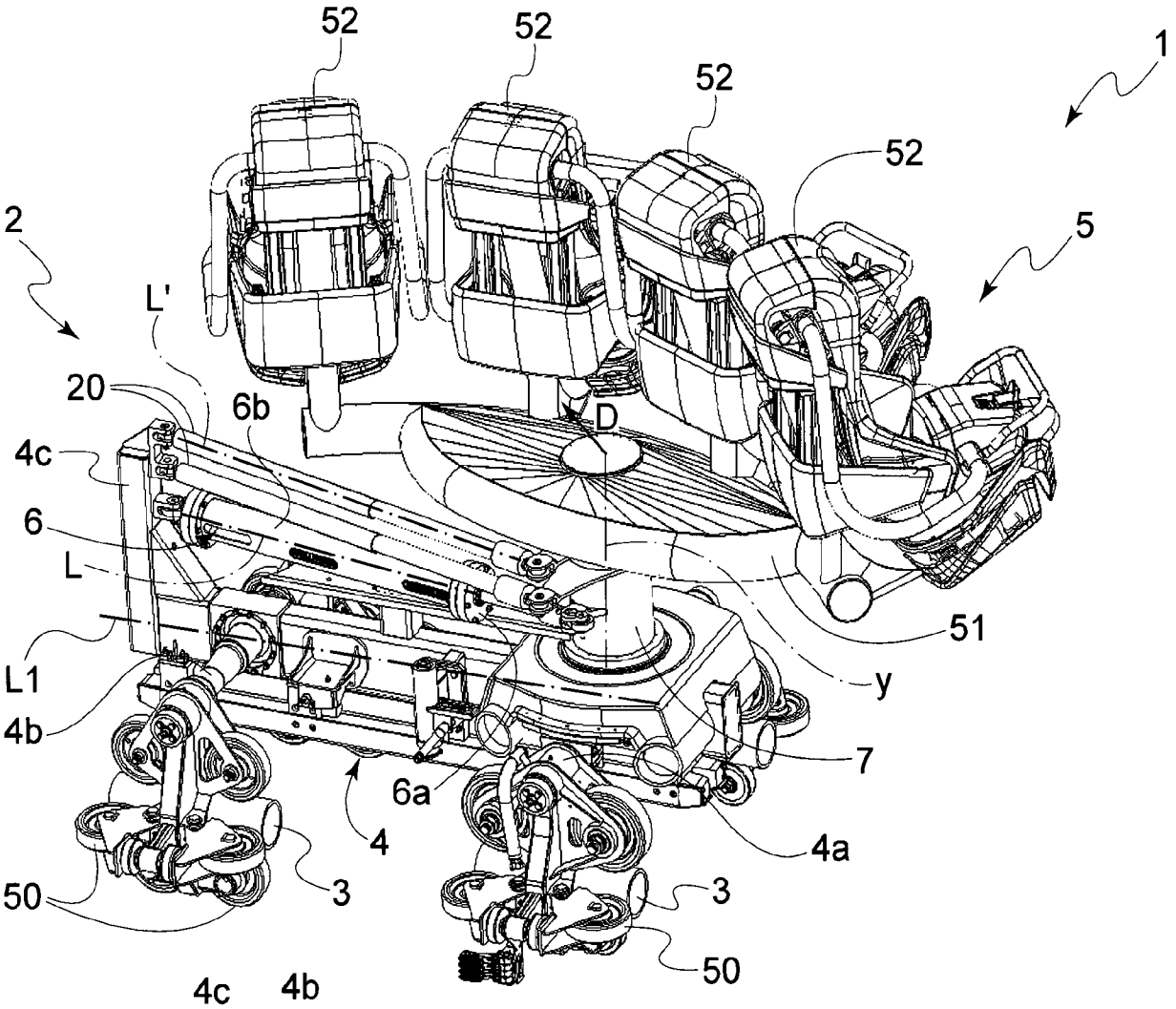
FIG. 2 is a perspective view of the amusement device of FIG. 1 when the passenger compartment is rotated about the pivot axis.
Figure 2A:
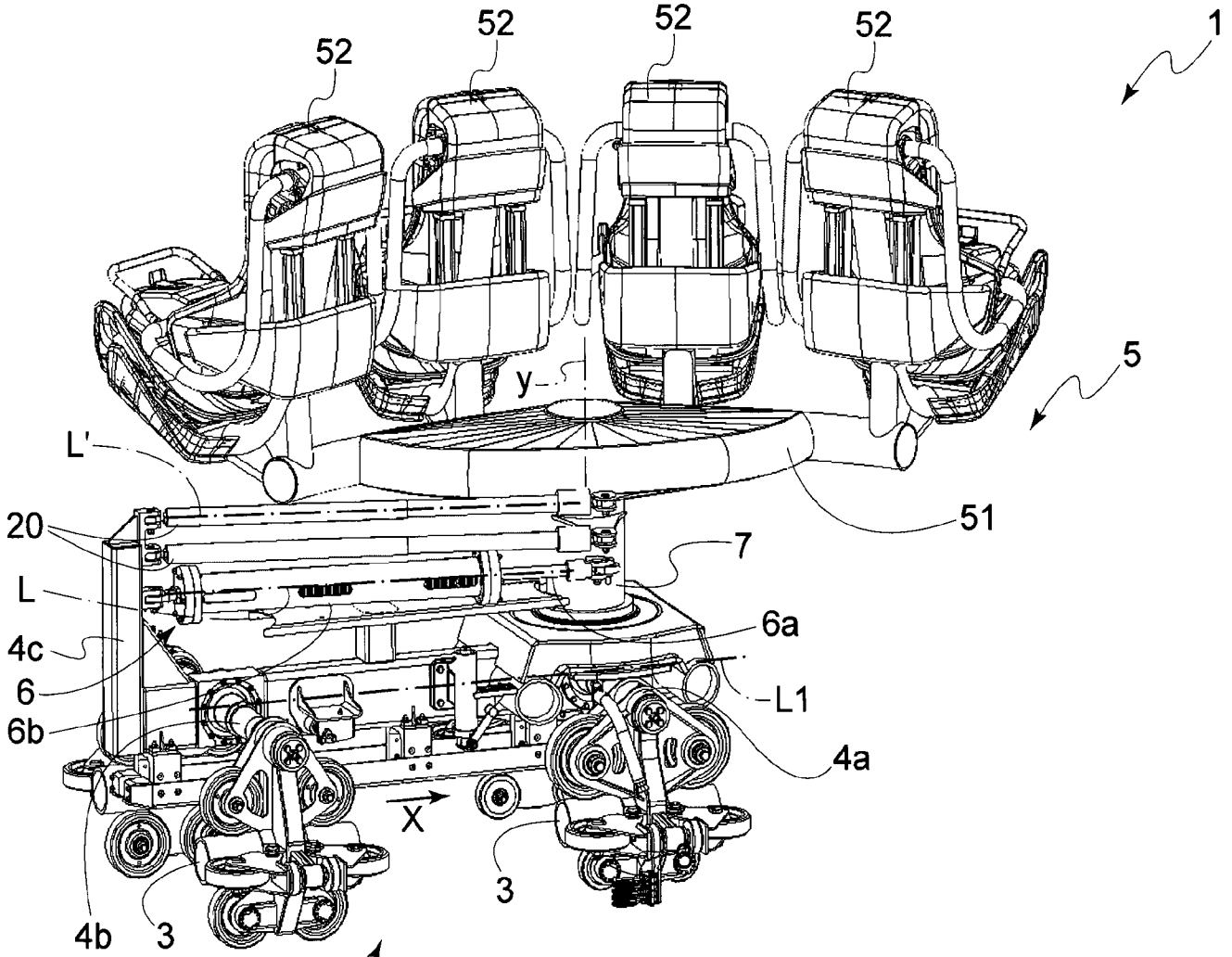
FIG. 2A is another perspective view of the amusement device of FIG. 1 passenger compartment is rotated about the pivot axis.

With reference to FIGS. 1, 2, 2A, the amusement device 1 comprises a vehicle 2 riding on a track 3, preferably on the upper side of the track, by means of a plurality of rollers 50, or similar rotating or sliding elements.

It has to be immediately noted that the track 3 is only partially visible in the FIGS. 1-2A and it is shown only in correspondence of the rollers 50 for clarity reasons.

The track can comprise a single rail, or two parallel rails. Also a configuration with more than two rails can be provided.

As known in the art, the track can be shaped to provide rectilinear and curved portions (turn). In general, the track can be designed to provide the desired movement of the vehicle during the ride, e.g. by providing alternations of rectilinear portions and turns (i.e. curved portions).

According to a preferred embodiment, the track comprises two rails and the vehicle 2 is supported thereon.

According to a preferred embodiment, the track comprises two rails, and the vehicle 2 is supported thereon. As mentioned above, the vehicle is also provided with suitable means to allow the movement along the track, preferably comprising a plurality of rollers.

The track can be a closed-type track, i.e. a track starting and ending the journey of the vehicle usually in a station for embarkation/disembarkation of the passengers.

It has to be also noted that the amusement device according to the invention is preferably of the roller coaster type, wherein the vehicle is not provided with propulsion means but the movement of the vehicle is generated by transporting the vehicle to an initial elevated part of the track.

The vehicle comprises a support frame 4, or chassis, and a compartment 5 having one or more seats 52 for housing one or more passengers. According to an embodiment the support frame 4 of the vehicle is generally provided with a front axle 4*a* and a rear axle 4*b*, where the rollers 50 or other moving means of the vehicle on the track are provided. The vehicle and in particular the support frame 4, or chassis, has a longitudinal extension (usually extending perpendicularly with respect to the axles 4*a*, 4*b*). More in detail a longitudinal axis L1 of the vehicle 2 is preferably directed substantially along the front-rear direction of the support frame 4 considering the advance direction X of the vehicle.

In other words, the longitudinal axis L1 connects the front and rear portion, e.g. it is extending perpendicularly with respect to both the front and rear axles 4*a*, 4*b* of the support frame 4.

The compartment 5, and thus the one or more seat 52 for the passenger, is moveably connected to the support frame 4 by a shaft 7 to rotate about an axis (or pivot axis) Y with respect to the support frame, from a first position P1 to at least one second position P2 in a rotation angular interval, at least when a centrifugal force acts on the passenger compartment 5.

More in detail, when the vehicle travels along a curved portion of the track the support frame 4 is guided to follow the curved track, while the passenger compartment 5 and thus the shaft 7 may rotate with respect to the support frame 4.

This is due for example by the fact that centrifugal force (also known as lateral or inertial force) acting on the vehicle causes a rotation of the passenger compartment 5 with respect to the support frame 4.

Also the rotation of the support frame 4 caused by the movement along a curve to follow the curved portion of the track is not transferred to the compartment 5. In particular, the rotation of the longitudinal axis L1 of the vehicle caused by the movement along a curve is not transferred to the passenger compartment 5 so that a rotation (pivoting movement of the passenger compartment and of the shaft 7) with respect to the support frame 4 about the pivot axis Y occurs.

It has to be noted that according to different possible embodiments, the rotation angular interval between the first position P1 and the second position P2 is equal to 115°, preferably equal to 105°, more preferably equal to 95°. In other words the maximum angular rotation of the vehicle compartment provides a rotation from a first position P1, that is usually a neutral position wherein the passenger compartment is arranged substantially in a centered position with respect to the longitudinal axis L1 of the vehicle. According to a possible embodiment, in the first position P1, the compartment 5 and thus the seats 52 are arranged substantially symmetrically with respect to the longitudinal axis L1.

As mentioned above, according to possible embodiments, the passenger compartment 5 can be rotated up to 115° (clockwise or counterclockwise), preferably up to 105° (clockwise or counterclockwise), more preferably up to 95° (clockwise or counterclockwise).

It has to be noted that the rotation angular intervals indicated above, can represent a rotation of the indicated angular interval on the right and a rotation of the indicated angular range on the left (clockwise or counterclockwise) so that the total rotation angular interval is up to 230°, preferably up to 210° and more preferably up to 190°. More in detail, according to an embodiment, the compartment 5 for the passengers is rotatable about said axis Y from a first position P1 to two second positions P2, at least when a centrifugal force acts on said compartment 5, said first position P1 being arranged between said two second positions P2.

It should be noted that although in the following reference will be made to a solution in which the compartment 5 is moveable between a first position P1 and two second positions P2 (respectively on the right and on the left of the first position P1), yet a solution that discloses a compartment 5 that is moveable between a first position P1 and only one second position P2 falls within the scope of protection of the present invention.

According to an embodiment, as for example shown in the FIGS. 2 and 2A, the compartment 5 rotates with respect to the support frame 4 of the vehicle 2 about said pivot axis Y between the first position P1 and the two second positions P2. In particular, the compartment 5 rotates with respect to the support frame 4 from a first position P1 to two second positions P2, at least when a centrifugal force acts on the compartment 5, wherein said first position P1 is arranged between said two second positions P2. Said compartment 5 reaches said two second positions P2 after, respectively, a clockwise or counterclockwise rotation with respect to said first position P1, or initial position.

FIGS. 2 and 2A show the compartment 5 rotated counterclockwise with respect to the first position P1 so that the compartment reaches a second position P2 that is arranged on the left with respect to the first position P1.

As mentioned above, according to an aspect of the invention the compartment 5 is provided with a plurality of seats 52 for the passengers and with a shaft 7 allowing the rotation about the pivot axis Y with respect to the support frame 4 of the vehicle. The compartment 5 also comprises a frame 51 intended to connect the seats 52 to the shaft 7. The frame 51 can comprise for example a support bar that is preferably curved so that the seats are arranged along a curved line. It is however possible that the seats 52 can be arranged along a straight line, preferably perpendicular with respect to the longitudinal axis L1 of the vehicle.

It has to be noted that the term "shaft" is used herein to indicate a connecting element of the passenger compartment 5 to the support frame, the connecting element or shaft being rotatable about the pivot axis Y together with the passenger compartment and in particular with seats 52. For example, the rotation of the compartment 5 and of the shaft 7 with respect to the support frame 4 can be obtained by a bearing arranged at the support frame 4.

According to an embodiment, the shaft 7 and thus the pivot axis Y is arranged at the front, e.g. in the frontal area or portion of the vehicle, and in particular of the support frame 4. More in detail, the pivot axis Y and thus the shaft 7 is arranged substantially in correspondence of the frontal axle 4*a* of the support frame 4.

It has to be also noted that according to an aspect of the invention, the pivot axis Y is substantially vertical.

According to an aspect the compartment 5 rotates about said vertical pivot axis Y on a substantially horizontal plane. In other words, the pivot axis Y is directed substantially perpendicularly with respect to the support frame 4. With reference to the track, the substantially vertical pivot axis, is substantially perpendicularly with respect to the advance direction X of the vehicle along the track.

Therefore, according to an embodiment the compartment 5 can be is rotated on a substantially horizontal plane that is substantially parallel to the support frame 4.

The term "substantially" means that the pivot axis Y can be slightly inclined with respect to the vertical condition (for example of an angle lower than 30°, preferably lower than 20°, more preferably lower than 10°).

According to an aspect, the compartment 5 for the passengers is preferably arranged in front of the pivot axis Y about which it rotates by the shaft 7. More in details, at least one seat 52 (and preferably all the seats) of the compartment 5 is arranged in front of the axis Y about which the shaft 7, and thus the compartment 5, rotates.

According to an embodiment, the one or more seats 52 of the compartment 5 is at a distance D equal to or less than 2 meters from the axis Y, preferably equal to or less than 1.5 meters, more preferably equal to or less than 1 meter. The distance D can be measured along a radial plane passing through the pivot axis Y, e.g. along a radial direction from the pivot axis Y.

Advantageously, according to an aspect of the invention the passenger compartment 5, and in particular the one or more seats 52, are arranged at a reduced distance D from the pivot axis Y so that the rotation movement thereof can be controlled effectively. The reduced distance D also allows reducing the overall size of the vehicle, especially when the compartment 5 and thus the seats 52 are rotated laterally.

Advantageously, the vehicle comprises at least one restoring element 6 configured to rotate back said passenger compartment 5 towards said first position P1 for at least part of the angular interval between said at least one second position P2 and said at least one first position P1, wherein said restoring element 6 is directly or indirectly constrained to said shaft 7.

The expression "for at least part of the angular interval between said at least one second position P2 and said at least one first position P1" is used herein to indicate that the restoring element exerts a restoring force intended to rotate back the compartment 5 towards the first position P1 only for a portion of the angular interval, i.e. only for a portion of the angle between the second position P2 reached by the compartment 5 due to the centrifugal force and the first position P1.

In other words, according to an aspect of the invention the restoring force is exerted by said restoring element 6 for a limited part of the rotation angular interval between said at least one second position P2 and said at least one first position P1.

It follows that, according to an embodiment, for an angular portion the restoring element 6 does not exert a restoring force on the compartment 5.

However, it could be also possible, according to an aspect of the invention that the restoring force is exerted by the at least one restoring element 6 for the complete rotation angular interval between the second position P2 and the first position P1.

The expression "directly or indirectly constrained to the shaft 7" means that the restoring element 6 can be directly constrained to the shaft, or constrained to another element that is rotating with the shaft, for example the restoring element 6 can be connect to the compartment 5, for example to the frame 51 that is rotating together with the shaft 7.

According to an embodiment, the restoring element 6 is constrained at one side to the shaft 7, or to an element rotating with the shaft, and at the opposite side to the vehicle, and in particular to the support frame 4.

According to an embodiment, the at least one restoring element 6 is constrained to a constraining post or strut 4*c* of the vehicle. The restoring element 6 is preferably constrained at the rear part of the vehicle, and in particular at the rear part of the support frame 4. For example, the restoring element can be constrained substantially in correspondence of the rear axle 4*b*, or between the rear axle 4*b* end the trailing end of the support frame 4.

According to an embodiment the post 4*c* is arranged at the trailing end of the support frame 4, as for example shown in the FIGS. 1-2A.

It has to be also noted that the restoring element 6 can be constrained to the shaft 7 and to the support frame 4 via a hinge, or similar connection joint, allowing a rotation component about an axis that is preferably parallel to the pivot axis Y.

According to an advantageous aspect of the invention, the restoring element 6 is radially arranged with respect to the pivot axis Y in at least one of said first position P1 and at least one second position P2, preferably in said first position P1. More in detail, as for example shown in FIG. 1, in the first position P1 the restoring element is arranged radially with respect to the pivot axis Y, thus the restoring element can effectively operate for both rotation directions (clockwise and counterclockwise) of the compartment 5 and thus of the shaft 7.

More in detail, according to an embodiment, in said first position P1 a longitudinal axis L of the restoring element 6 lies in a radial plane that is passing through the axis Y. It has to be noted that the term "longitudinal axis of the restoring element" is herein used to indicate the direction along which the restoring element has its predominant dimension, or the direction wherein the restoring element has its extension in length. According to an embodiment, as for example shown in the figures, the longitudinal axis L of the restoring element 6 is perpendicular to the pivot axis Y.

It has to be also noted that according to an embodiment, in the first position P1 the longitudinal axis L of the restoring element 6 is coincident, or parallel, to the longitudinal axis L1 of the vehicle, and/or coincident, or parallel, to the advance direction X of the vehicle along the track.

In other words, according to an advantageous aspect of the invention, the restoring element is aligned with the longitudinal axis L1 of the vehicle, and/or to the direction of movement X of the vehicle along the track, so that in the first position P1 of the compartment, e.g. a central or neutral position thereof, the restoring element is also in "alignment" (in-line) with the central or neutral position so that it can effectively operate in both rotation directions (clockwise and counterclockwise) of the compartment 5.

More in detail, according to an aspect of the invention, the restoring element 6 is in "alignment" (in-line) with the pivot axis Y such that it works in the same way for the compartment 5 and thus for the seats 52 turning in each direction (clockwise or counterclockwise).

According to an advantageous aspect of the invention, the restoring element is arranged to be equidistant from the two ends of an axle 4*a*, 4*b* of the vehicle.

According to an aspect of the invention, the vehicle 2 is further provided with at least one damping element 20 configured to damp said passenger compartment 5 for at least part of the rotation angular interval between the at least one second position P2 and the at least one first position P1.

The damping element can comprise at least one hydraulic or pneumatic damper, for example a hydraulic or pneumatic damper cylinder (as for example shown in FIGS. 1, 2, 2A). According to different possible embodiments, the number of damping element 20 can be selected in order to effectively damp the rotation of the compartment 5, according to an embodiment as for example shown in the figures, two damping elements 20, e.g. two hydraulic dampers, are used.

The damping element 20 can be directly or indirectly constrained to the shaft 7. As already mentioned above in connection to the restoring element, the expression "directly or indirectly constrained" to the shaft 7 means that the damping element 20 can be directly constrained to the shaft, or constrained to another element that is rotating with the shaft, for example the damping element 20 can be connect to the compartment 5, for example to the frame 51 that is rotating together with the shaft 7. In general, it has to be noted that what is disclosed about the constraining of the restoring element with the shaft 7 and with the support frame 4, and in particular the rear post 4*c*, can be applied also to the at least one damping element.

More in detail, according to a preferred embodiment, the at least one damping element 20, preferably two damping elements 20, are constrained to the shaft 7 and to the support frame 4 substantially in a similar way of constraining of the restoring element to these components.

It has to be noted also that what is disclosed in connection to the restoring element 20 about its arrangement in the vehicle can be applied to the damping element 20.

More in detail, according to an embodiment, the at least one damping element 20 is arranged in the same plane of the at least one restoring element 6. More in detail, the damping element, e.g. two hydraulic dampers, is coplanar with the restoring element 6, and preferably is radially arranged with respect to the pivot axis Y in at least one of said first position P1 and at least one second position P2, preferably in said first position P1.

According to an embodiment the at least one damping element 20 is arranged above the restoring element 6, while being contained in the same plane that is also passing through the pivot axis Y.

According to an embodiment, in the first position P1 a longitudinal axis L' of the damping element 20 lies in a radial plane that is passing through the axis Y.

As already mentioned in connection to the restoring element, the term "longitudinal axis of the damping element" is herein used to indicate the direction along which the damping element has its predominant dimension, or the direction where the damping element has its extension in length. For example, the longitudinal axis L' of the hydraulic damper corresponds to the longitudinal extension of the hydraulic cylinder. According to an embodiment, as for example shown in the figures, the longitudinal axis L' of the damping element 20 is perpendicular to the pivot axis Y.

It has to be also noted that according to an embodiment, in the first position P1 the longitudinal axis L' of the damping element 20 is coincident, or parallel, to the longitudinal axis L1 of the vehicle, and/or coincident or parallel to the advance direction X of the vehicle along the track.

In other words, according to an advantageous aspect of the invention, the damping element 20 is aligned with the longitudinal axis and/or to the direction of movement X of the vehicle along the track, so that in the first position P1 of the compartment, e.g. a central or neutral position thereof, the damping element 20 is also in "alignment" with the central or neutral position so that it can effectively damp rotations in both rotation directions (clockwise and counterclockwise) of the compartment 5.

The rotation of the compartment 5, and thus of the shaft 7, to which the damping element 20 is connected, from the first position P1 (see for example FIG. 1) to at least one second position P2 (see for example FIGS. 2-2A) determines an extension of the damping element 20, and in particular of the damping cylinder.

More in detail, according to an embodiment, the damping effect is exerted by an extension i.e. movement away of a portion of the damping element with respect to a second portion of the damping element. More in detail, the damping effect can be generated by a movement of a rod of the damping element outwards of a cylinder casing of the damping element 20.

It has to be noted that the rotation of the compartment is damped by means of the at last one damping element preferably for the complete rotation angular interval between the first position P1 and the at least one second position P2. More in detail, according to an embodiment the rotation of the compartment 5 is always damped, i.e. rotation is damped for the complete angular interval between P1 and P2.

However, it could be also possible to provide damping of the compartment 5, i.e. to damp the rotation, only for a limited part of the rotation angular interval between the first position P1 and the second position P2.

Returning now to the restoring element 6 of the amusement device according to the invention, it comprises a spring 6*c*, preferably an extension spring.

It has to be noted that the term "extension spring" is used to indicate a spring exerting a restoring force when the spring itself is extended by applying a tension thereon from a not-deformed condition to a deformed (extended) condition and tends to return in its not-deformed (not-extended condition), or to indicate that the restoring element 6 is configured as an extension mechanism comprising two portions 6*a*, 6*b* which are movable one with respect to another and the restoring force is exerted by moving away one portion from another, i.e. extending (e.g. moving away) one portion from another that tends to return towards the initial relative position, i.e. to the not-deformed (not-extended condition).

Although a reference to an extension spring has been made, it has to be noted that according to possible embodiments also a compression spring can be used for exerting the restoring force, i.e. when the restoring force is exerted by a spring that is compressed to a deformed (compressed) condition and tends to return in its not-deformed (not-compressed) condition.

Figure 3:
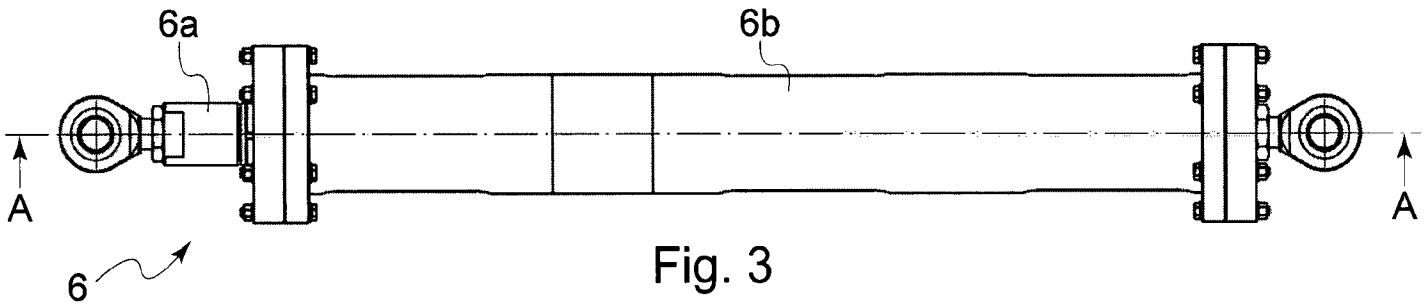
FIG. 3 is a detailed view of a possible embodiment of a restoring element.
Figure 3A:
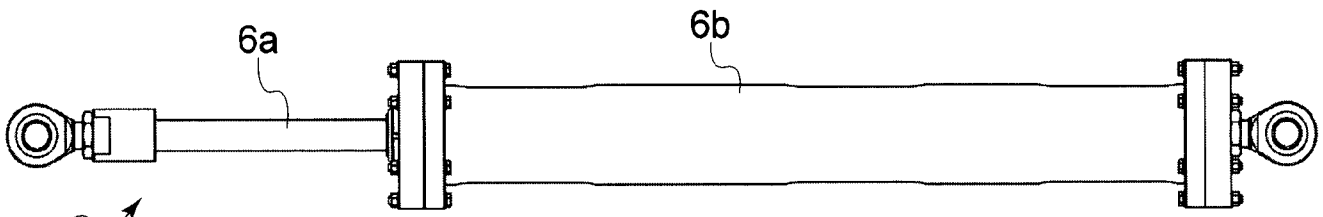
FIG. 3A is a detailed view of a possible embodiment of a restoring element according to FIG. 3 in the extended position.
Figure 3B:
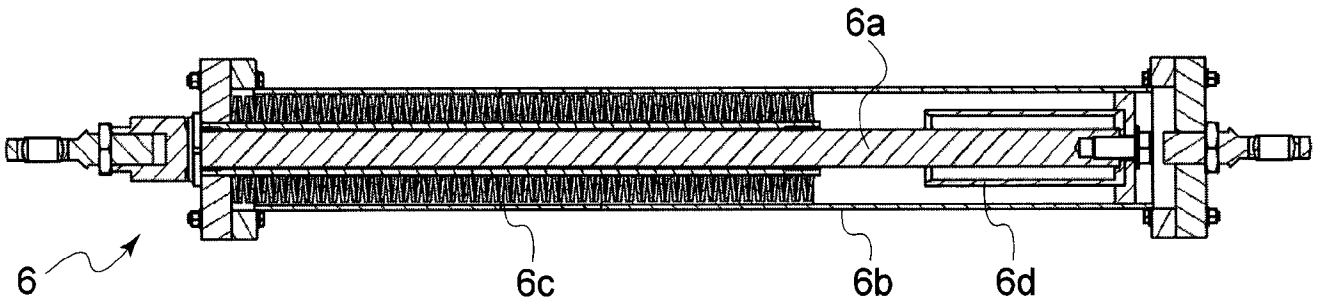
FIG. 3B is a detailed section view of a possible embodiment of a restoring element according to the plane A-A of FIG. 3.

According to an aspect, as for example visible in FIGS. 3, 3*a* and 3*b* showing a possible embodiment of the restoring element 6, the rotation of the compartment for the passenger 5 (and thus of the shaft 7) about pivot axis Y from said first position P1 towards the at least one second position P2 provides an extension of the restoring element 6. As mentioned above, the rotation also provides an extension of the damping element 20.

More in detail, according to an embodiment, as for example shown in the FIGS. 3, 3A, 3B, the restoring element 6 comprises a first portion 6*a* directly or indirectly constrained to the shaft 7, a second portion 6*b* directly or indirectly constrained to the vehicle (and in particular to the support frame 4, preferably at a rear post 4*c*) and a spring 6*c*.

The first portion 6*a* and second portion 6*b* are movable one with respect to another and are configured so that a restoring force is exerted on the passenger compartment 5 for at least part of movement of the first portion 6*a* with respect to the second portion 6*b*, and viceversa.

More in detail, the first portion 6*a* is constrained to the shaft 7 and can comprise a rod that is movable at least in part within the second portion 6*b* of the restoring element that can be configured as a cylindrical casing 6*b*, inside which at least one spring 6*c* is arranged.

The first portion 6*a* and the second portion 6*b* of the restoring element 6 are respectively constrained with the shaft 7 and with the support frame 4 (e.g. to the post 4*c*), or viceversa, by means of a hinge or similar joint allowing a component of rotation.

Preferably, the hinge and in general the connecting joint of the restoring element 6 with the shaft 7 and with the support frame 4 allows a component of rotation about an axis that is parallel with respect to the pivot axis Y about which the shaft 7 rotates.

As mentioned above, according to an embedment, the restoring element exerts a force only for a part of the rotation angular interval between the second position P2 and the first position P1. According to an embodiment, the spring 6*c* of the restoring element 6 is dimensioned so that at least part of the movement of the first part 6*a*, or rod, with respect to the second part 6*b*, or casing, is free.

More in detail, according to an embodiment the spring 6*c* is not contacted by one of the two portions 6*a*, 6*b* and thus the restoring force is not exerted.

More in detail, the spring 6*c* has length that is less that the length of the cylindrical casing 6*b* and in particular the spring has a length less than the stroke of the rod 6*a* within the casing 6*b*.

Therefore, the abutting portion 6*d* of the rod 6*a* is not in contact with the spring for at least part of the extension movement (from right to left in the embodiment shown in FIG. 3B), i.e. the movement of the rod 6*a* towards outside of the casing. Only after a part of the extension movement, the abutting portion 6*d* connected to the movable rod 6*a* contacts the spring 6*c* causing a compression thereof, thus exerting a restoring force caused by the return of the spring in its not-deformed condition.

The free relative movement of the two portions 6*a*, 6*b* of the restoring element corresponds to a free angular rotation of the compartment (eventually damped if the damping element 20 is configured to damp the entire rotation angular interval) from the first position P1 towards the second position P2 and in particular towards a "intermediate" position, i.e. a position between the first position P1 and the second position P2 (the intermediate position being not necessarily in the middle of the angular interval between the first position and second position but being any position therebetween).

Therefore, the rotation of the compartment 5 is free to move up until a certain angle, for example an angle of 60° from the first position P1 at which the restoring element 6 starts exerting the restoring force, for example by having the abutting portion 6*d* engaging the spring 6*c*, that can be for example in the form of one or more pre-compressed disc springs.

Therefore, according to an aspect, the compartment 5 is arranged in the first position P1, or initial position or centered position (see for example FIG. 1), i.e. when it is not still subjected to a centrifugal force or when the centrifugal force is less than the force exerted by the restoring element.

In FIG. 2-2A, the vehicle 2 has just terminated a turn and the compartment 5 is still in one of the two second positions P2 because of the centrifugal force. The restoring element 6 provides a restoring force intended to rotate back the compartment 5 towards the first position P1.

As already mentioned above, if the restoring element is configured to exert the restoring force only for a limited part of the rotation angular interval between the second position P2 and the first position P1, the restoring force exerted by the restoring element 6 will rotate back the compartment 5 towards the first position P1 but, without reaching the first position P1. In fact, if the restoring force is exerted only for a part of the rotation angular interval between the first position and the second position, the compartment will be rotated back by the restoring force to an "intermediate position", i.e. a position arranged between the second position P2 and the first position P1.

In this case the rotation of the compartment 5 could be free for the part of the rotation angular interval between P1 and the intermediate position where the restoring force is not exerted, or the rotation in this angular interval is damped by the damping element 20 if the damping element is configured to provide a damping effect for the complete angular interval between the first position P1 and the second position P2.

More in detail as for example shown in the figures, the damping element is configured to damp the complete rotation angular interval between the first and second position, while the restoring element is configured to exert a restoring force only for a part of the rotation angular interval between P1 and P2.

It has to be noted that a final stop, or final hardstop, can be provided for limiting the rotation of the compartment at the maximum second position, i.e. at the end of the rotation angular interval between P1 and P2.

The final stop can comprises two travel stops arranged along the path of the compartment or of the shaft 7 to limit the rotation of the compartment at the two second positions P2.

According to preferred embodiment, the final hardstop, for example at 115° of the angular interval, can be provided by the restoring element 6. For example, when the abutting portion 6*d* of the rod 6*a* compress completely the spring 6*c* arranged therein. According to an embodiment, the restoring element 6 is configured in such a way that the restoring force, for example exerted by the spring, is small at small angles of rotation and much larger at higher angles of rotation of the compartment from the first position P1. In other words, the farther the compartment 5 and thus the seats 52 rotate from the first position P1, the stronger the restoring force. More in detail according to an aspect, the restoring element is arranged so that an increased restoring force is exerted when the angle is about 90°.

Figure 4:
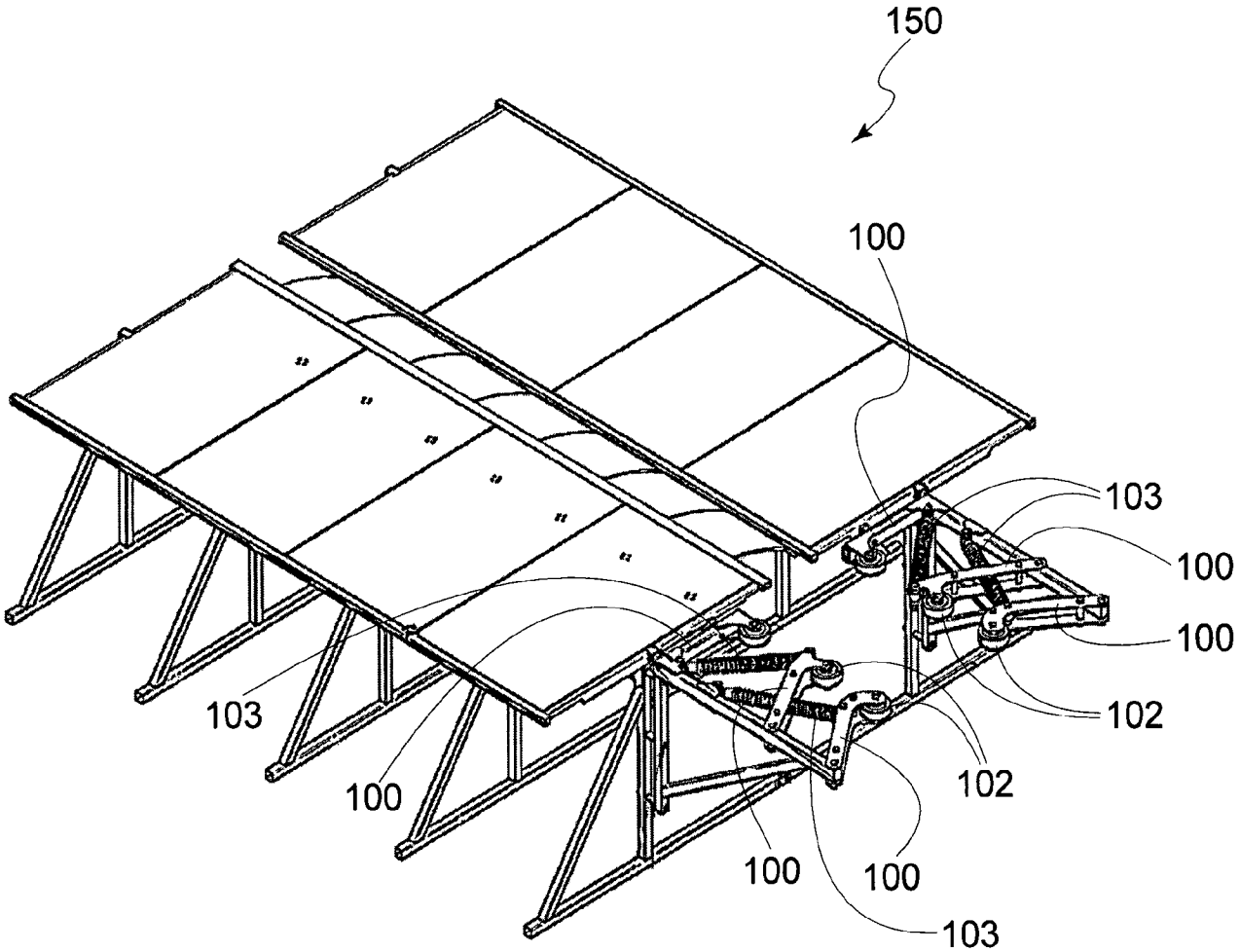
FIG. 4 is a perspective view of a possible embodiment of a station for embarkation/disembarkation of the passenger for an amusement device according to the invention.
Figure 4A:
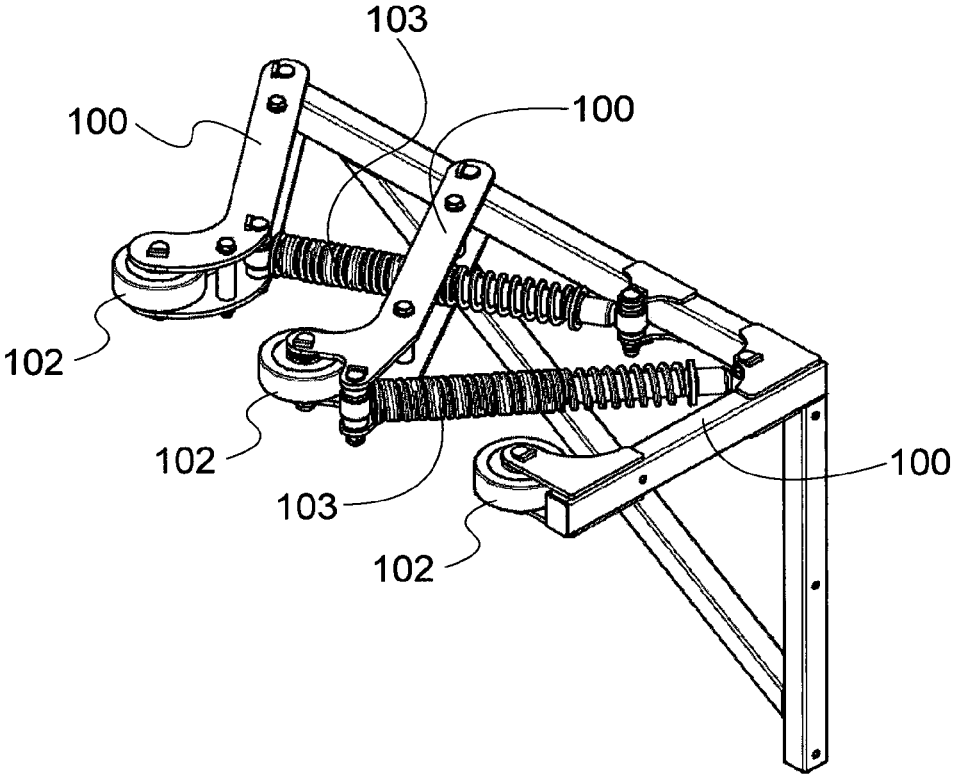
FIG. 4A is a detailed view of a possible embodiment of a plurality of positioning element intended to move the passenger compartment in said first position.

According to an embodiment, as for example shown in FIGS. 4 and 4A, the amusement device according to the invention is provided with at least one positioning element 100 configured to move the passenger compartment 5 in said first position P1. Advantageously, the positioning element 100 allows to rotate back completely the compartment 5 in the first position P1 especially when the restoring element 6 is configured to rotate back the compartment only for a part of the rotation angular interval between P1 and P2.

Preferably, the positioning element 100 is contacting directly or indirectly said passenger compartment 5. The term "directly or indirectly" is used to indicate that the contact can be obtained directly with the compartment 5 or with an element 110 that is rotated together the compartment 5. For example, according to a possible embodiment two arms 110 protruding from the shaft 7 (see for example FIG. 1 and FIG. 5) can be provided to be contacted by the positioning element 100 in order to rotate back completely the compartment 5 to the first position P1.

According to an embodiment, the at least one positing element 100, preferably a plurality of positioning elements 100, are arranged outside the vehicle, preferably along a side of the track, or at both sides of the track.

Advantageously the positioning element 100 contact directly or indirectly the compartment 5, causing to rotate it back to the first position, while the vehicle is advancing along the track 3.

Figure 5:
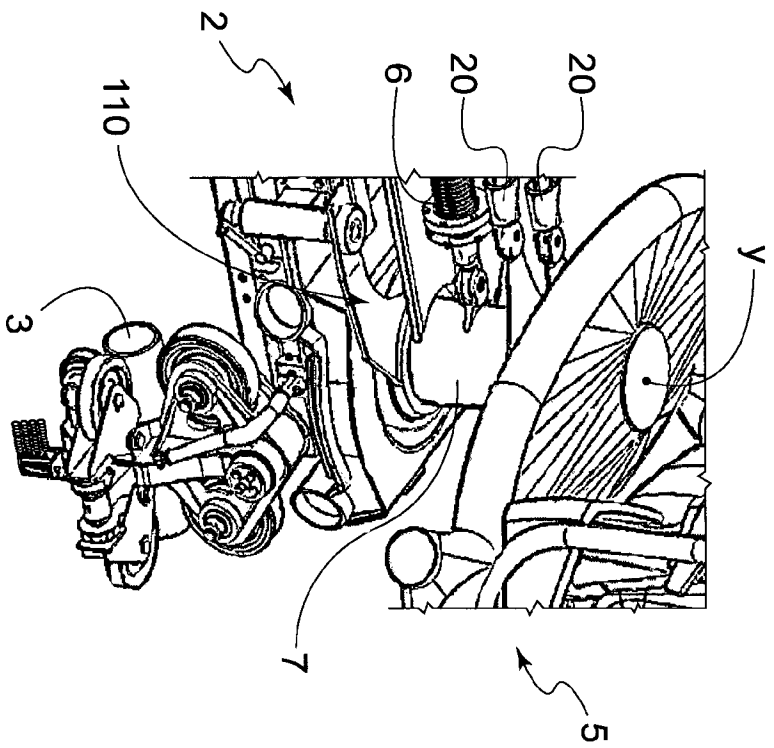
FIG. 5 is an enlarged view of the shaft of the vehicle according to the invention, wherein is shown the arm intended to cooperate with positioning element to move the compartment in the first position when the vehicle is at station for the embarkation/disembarkation of passenger.

More in detail, as for example shown in FIGS. 4 and 4A, the positioning element 100 comprises at least one arm intended to contact the compartment 5, or contacting an arm 110 constrained to the shaft 7, as for example shown in FIG. 1 and in the detailed view of FIG. 5. Even if only one arm 110 is shown, it has to be noted that according to a preferred embodiment the arm 110 intended to be contacted by the positioning element 100 are arranged symmetrically with respect to the pivot axis Y. In other words, two arms 110 are preferably arranged at both sides of the pivot axis Y.

The positioning element 100 can be movable, preferably rotatable, and the movement can be spring biased by a spring 103 or similar elastic means. In addition or in alternative, the movement (e.g. rotation) of the positioning element 100 can be damped by one or more damping element.

The arm of the positioning element 100, as well as the arm 110 of the vehicle can be provided with a roller 102 so that the contact can be obtained while the vehicle is advancing along the track and the rotation of the compartment can be guided smoothly. According to an embodiment, the positioning element 100 is arranged in correspondence of, or at the entrance of, a station 150 for the embarkation/disembarkation of the passenger into/from the passenger compartment 5. The arrangement of the positioning element 100 in correspondence of, or at the entrance of, a station 150 advantageously allows to completely return back the compartment 5 in the first position P1 when the vehicle is at the station and thus the embarkation/disembarkation operations can be carried out with the compartment at a predetermined portion corresponding to the first position P1.

It has to be also noted that the station 150 used in the amusement device according to the invention can be of the type disclosed in WO2016/151113 in the name of the same applicant.

More in detail, as disclosed in WO2016/151113, the station can comprise at least one platform arranged above a portion of a track in correspondence of the station, and an opening) for the transit of the at least one vehicle in said station, at least one floor element arranged in at least one first position in which said floor element closes said opening and movable from said at least one first position to at least one second position to allow the transit of said vehicle in said station, further comprising returning means configured to move said at least one floor element from said at least one second position back to said at least one first position in which said floor element closes said opening.

The invention claimed is:

1. Amusement device (1) comprising a vehicle (2) riding on a track (3), said vehicle comprising a support frame (4) and a compartment (5) having one or more seats (52) for housing one or more passengers, the compartment being moveably connected to said support frame by a shaft (7), to rotate about an axis (Y) with respect to said support frame, from a first position (P1) to at least one second position (P2) in a rotation angular interval, at least when a centrifugal force acts on the passenger compartment (5), characterized in that said vehicle comprises at least one restoring element (6) configured to rotate back said compartment (5) towards said first position (P1) for at least part of the angular interval between said at least one second position (P2) and said at least one first position (P1), wherein said restoring element (6) is directly or indirectly constrained to said shaft (7) and wherein in said first position (P1) a longitudinal axis (L) of the restoring element (6) is coincident or parallel to the longitudinal axis (L1) of the vehicle, and/or coincident or parallel to the advance direction (X) of the vehicle along the track.

2. Amusement device according to claim 1, wherein said restoring element (6) is radially arranged with respect to said axis (Y) in at least one of said first position (P1) and at least one second position (P2).

3. Amusement device according to claim 2, wherein said restoring element (6) is radially arranged with respect to said axis (Y) in said first position (P1).

4. Amusement device according to claim 1, wherein in said first position (P1) a longitudinal axis (L) of the restoring element (6) lies in a radial plane that is passing through the axis (Y).

5. Amusement device according to claim 1, wherein a longitudinal axis (L) of the restoring element (6) is perpendicular to said axis (Y).

6. Amusement device according to claim 1, wherein said compartment (5) for the passengers is arranged in front of the axis (Y), with respect to the advance direction (X) of the vehicle along the track (3).

7. Amusement device according to claim 1, wherein said one or more seats (52) of the compartment (5) is at a distance (D) from the axis (Y) equal to or less than 2 meters.

8. Amusement device according to claim 7, wherein said one or more seats (52) of the compartment (5) is at a distance (D) from the axis (Y) equal to or less than 1.5 meters.

9. Amusement device according to claim 8, wherein said one or more seats (52) of the compartment (5) is at a distance (D) from the axis (Y) equal to or less than 1 meter.

10. Amusement device according to claim 1, wherein the rotation of said compartment for the passenger (5) from said first position (P1) towards the at least one second position (P2) provides an extension of said restoring element (6).

11. Amusement device according to claim 1, wherein said at least one restoring element (6) comprises at least one spring (6*c*).

12. Amusement device according to claim 11, wherein said at least one spring (6*c*) is an extension spring.

13. Amusement device according to claim 1, wherein said restoring element (6) comprises a first portion (6*a*) directly or indirectly constrained to the shaft (7), a second portion (6*b*) directly or indirectly constrained to the vehicle and a spring (6*c*), the first portion and second portion are movable one with respect to another and are configured so that a restoring force is exerted for at least part of movement of the first portion (6*a*) with respect to the second portion (6*b*).

14. Amusement device according to claim 1, wherein a restoring force is exerted by said restoring element (6) for a limited part of the rotation angular interval between said at least one second position (P2) and said at least one first position (P1).

15. Amusement device according to claim 1, further comprising at least one damping element (20) configured to damp said passenger compartment (5) for at least part of the rotation angular interval between said at least one second position (P2) and said at least one first position (P1).

16. Amusement device according to claim 15, wherein said at least one damping element (20) is arranged in same plane of the at least one restoring element (6).

17. Amusement device according to claim 15, wherein in said first position (P1) a longitudinal axis (L') of the damping element (20) is coincident or parallel to the longitudinal axis (L1) of the vehicle, and/or coincident or parallel to the advance direction (X) of the vehicle along the track.

18. Amusement device according to claim 15, wherein said damping element (20) is radially arranged with respect to said axis (Y) in at least one of said first position (P1) and at least one second position (P2).

19. Amusement device according to claim 15, wherein in said first position (P1) a longitudinal axis (L') of the damping element (20) lies in a radial plane that is passing through the axis (Y).

20. Amusement device according to claim 15, wherein a longitudinal axis (L') of the damping element (20) is perpendicular to axis (Y).

21. Amusement device according to claim 15, said at least one damping element (20) being directly or indirectly constrained to said shaft (7).

22. Amusement device according to claim 15, wherein said damping element (20) is radially arranged with respect to said axis (Y) in said first position (P1).

23. Amusement device according to claim 1, wherein the angular interval between the first position (P1) and the second position (P2) is equal to 115°, preferably equal to 105.

24. Amusement device (1) according to claim 1, wherein said at least one compartment (5) for the passengers is rotatable about said axis (Y) from a first position (P1) to two second positions (P2), at least when a centrifugal force acts on said compartment (5), said first position (P1) being arranged between said two second positions (P2).

25. Amusement device according to claim 1, wherein said shaft (7) is arranged at the front of the vehicle.

26. Amusement device according to claim 1, wherein said axis (Y) is substantially vertical.

27. Amusement device according to claim 1, wherein said restoring element (6) is of the passive type.

28. Amusement device according to claim 1, further comprising at least one positioning element (100) configured to move said passenger compartment (5) in said first position (P1).

29. Amusement device according to claim 28, wherein said positioning element (100) is arranged outside the vehicle (2), the positioning element (100) contacting said compartment (5) while the vehicle is advancing along the track (3).

30. Amusement device according to claim 28, wherein said positioning element (100) is arranged in correspondence of, or at the entrance of, a station (150) for the embarkation/disembarkation of the passenger into/from the passenger compartment (5).

31. Amusement device according to claim 28, further comprising at least one positioning element (100) contacting directly or indirectly said passenger compartment (5).

32. A method of operating an amusement device (1) according to claim 1, comprising the step of moving said vehicle (2) along a track (3), a compartment (5) of the vehicle having one or more seats (52) for housing one or more passengers being rotated about an axis (Y) with respect to said support frame, from a first position (P1) to at least one second position (P2) in a rotation angular interval, at least when a centrifugal force acts on the passenger compartment (5) during the movement along the track, further comprising the step of rotating back said compartment (5) towards said first position (P1) for at least part of the angular interval between said at least one second position (P2) and said at least one first position (P1) by said at least one restoring element (6).

33. Amusement device according to claim 1, wherein the angular interval between the first position (P1) and the second position (P2) is equal to 105°.

34. Amusement device according to claim 33, wherein the angular interval between the first position (P1) and the second position (P2) is equal to 95°.

* * * * *